US008506124B2

(12) United States Patent
Chen et al.

(10) Patent No.: US 8,506,124 B2
(45) Date of Patent: Aug. 13, 2013

(54) LIGHT-EMITTING DEVICE AND METHOD

(75) Inventors: Chin-Feng Chen, Taipei Hsien (TW); Fang-Lun Wu, Shenzhen (CN)

(73) Assignees: Fu Tai Hua Industry (Shenzhen) Co., Ltd., Shenzhen (CN); Hon Hai Precision Industry Co., Ltd., New Tapei (TW)

( * ) Notice: Subject to any disclaimer, the term of this patent is extended or adjusted under 35 U.S.C. 154(b) by 343 days.

(21) Appl. No.: 12/894,183

(22) Filed: Sep. 30, 2010

(65) Prior Publication Data

US 2012/0013270 A1 Jan. 19, 2012

(30) Foreign Application Priority Data

Jul. 13, 2010 (CN) ..... 2010 1 0224642

(51) Int. Cl.
*F21V 23/04* (2006.01)

(52) U.S. Cl.
USPC ..... 362/276; 362/234; 362/253; 362/318; 362/351; 315/307

(58) Field of Classification Search
USPC ..... 362/234, 253, 276, 318, 351, 352, 362/398; 315/307
See application file for complete search history.

(56) References Cited

U.S. PATENT DOCUMENTS

2004/0105264 A1* 6/2004 Spero ..... 362/276

* cited by examiner

*Primary Examiner* — Stephen F Husar
*Assistant Examiner* — Meghan Dunwiddie
(74) *Attorney, Agent, or Firm* — Altis Law Group, Inc.

(57) ABSTRACT

A light-emitting method is provided. The light-emitting method is applied in a light-emitting device. The light-emitting device includes an emitting member to emit light. The light-emitting method includes detecting an air pressure of the light-emitting device and controlling the emitting member to emit light with color and luminance value according to the detected air pressure. A related light-emitting device is also provided.

18 Claims, 5 Drawing Sheets

LIGHT-EMITTING DEVICE AND METHOD

BACKGROUND

1. Technical Field

The present disclosure relates to light-emitting devices and light-emitting methods and, particularly, to a light-emitting device capable of emitting light with various colors and luminance and a method for controlling the light-emitting device to emit light.

2. Description of Related Art

LED lamps are becoming a more popular choice than conventional bulb lamps for use in many conventional illumination applications, such as table lamps. However, conventional LED lamps only can emit light with a single color, which may not satisfy users' different demands.

BRIEF DESCRIPTION OF THE DRAWINGS

The components in the drawings are not necessarily drawn to scale, the emphasis instead being placed upon clearly illustrating the principles of a light-emitting device and a light-emitting method. Moreover, in the drawings, like reference numerals designate corresponding parts throughout the several views.

DETAILED DESCRIPTION

Figure 1:
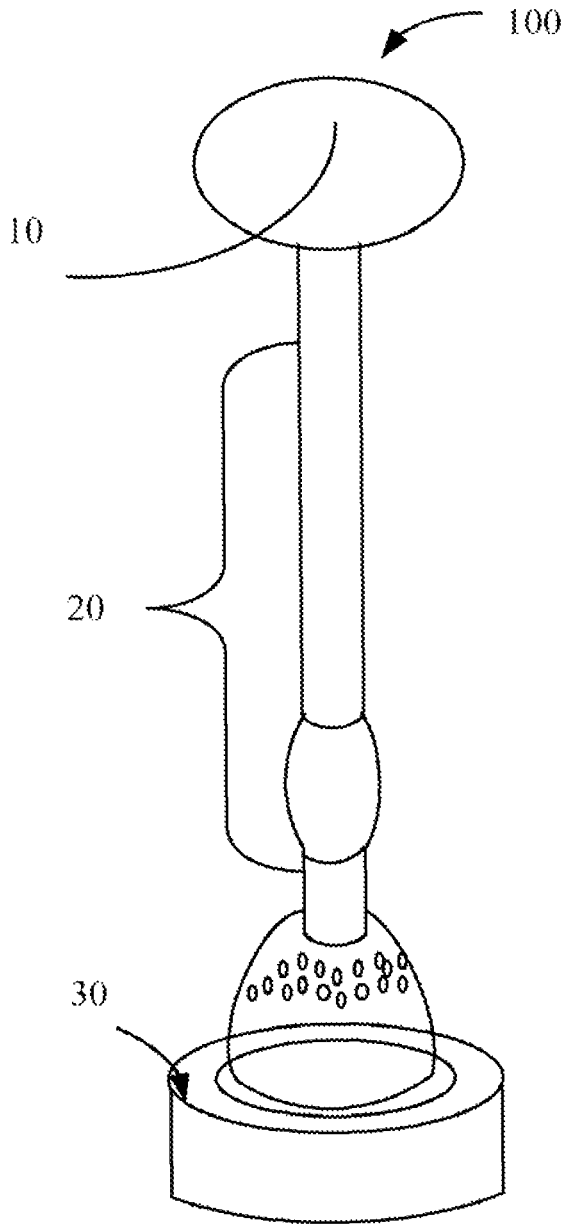
FIG. 1 is an isometric view of a light-emitting device in accordance with an exemplary embodiment.
Figure 2:
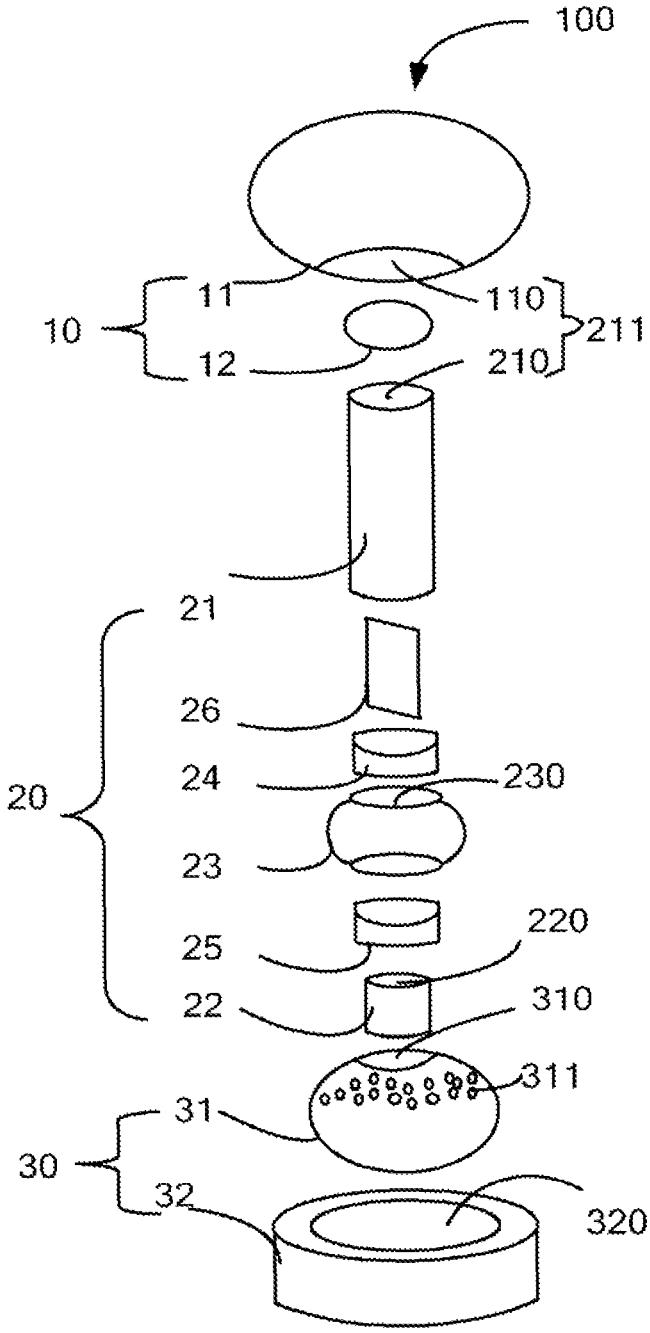
FIG. 2 is an exploded, perspective view of the light-emitting device of FIG. 1.

Referring to FIGS. 1-2, a light-emitting device 100 in accordance with an exemplary embodiment is shown. The device 100 includes a head 10, a support 20, and a base 30. Two opposite ends of the support 20 are respectively connected to the head 10 and the base 30.

The head 10 includes a lampshade 11 and an emitting member 12. The lampshade 11 defines a receiving space 110 with an opening (not labeled). The emitting member 12 is received in the receiving space 110. In the embodiment, the lampshade 11 is filled with gas and the volume of the lampshade 11 correspondingly changes when the air pressure of the lampshade 11 changes. The volume of the lampshade 11 increases while the air pressure of the lampshade 11 increases, and the volume decreases while the air pressure of the lampshade 11 decreases. The lampshade 11 is made of transparent material. The lampshade 11 may be balloon-shaped. The emitting member 12 emits light with various colors, such as, green light, red light, blue light, or light with mixed colors.

The support 20 includes a first rod 21, a second rod 22, an inflatable bag 23, a first valve 24, a second valve 25, and a circuit board 26.

The first rod 21 and the second rod 22 respectively define through holes 210 and 220 along axes of the first rod 21 and the second rod 22. The emitting member 12 is attached to a top end of the first rod 21. The top end of the first rod 21 is attached to the lampshade 11, and the through hole 210 and the receiving space 110 cooperatively form a chamber 211. The first valve 24 is fixedly received in the through hole 210 to allow gas to flow through. Opposite ends of the second rod 22 are respectively attached to the inflatable bag 23 and the base 30. The second valve 25 is fixedly received in the through hole 220 to allow gas to flow through. The first valve 24 and the second valve 25 are both check valves and allow gas to flow through the first valve 24 and the second valve 25 in a direction towards the lampshade 11.

The inflatable bag 23 is made of elastic material. The inflatable bag 23 defines a through hole 230 along an axis thereof. Opposite ends of the inflatable bag 23 are respectively attached to the first rod 21 and the second rod 22. The inflatable bag 23 inflates the chamber 211 to make the size of the lampshade 11 increase in response to extrusion of the inflatable bag 23 through the through hole 230.

The circuit board 26 is secured in the through hole 210 and electrically connected to the emitting member 12. The circuit board 26 detects the air pressure of the chamber 211 and control the emitting member 12 to emit light according to the detected air pressure.

The base 30 includes a positioning member 31 and a stand 32. The positioning member 31 defines a receiving space 310 with an opening, and is attached to the bottom end of the second rod 22. The receiving space 310 communicates with the through hole 220. The positioning member 31 defines a number of holes 311, from which the gas can go into the positioning member 31 flowing to the second rod 22 and exhaust from the positioning member 31. In one embodiment, the positioning member 31 is spheroidal. At least a portion of the positioning member 31 is made of magnetic or magnetizable material.

The stand 32 defines a recessed portion 320 to receive the positioning member 31. When the positioning member 31 is received in the recessed portion 320, the holes 311 of the positioning member 31 are exterior to the recessed portion 320. At least a portion of the stand 32 is made of magnetic or metal material. In one embodiment, when at least a portion of the positioning member 31 is made of magnetic material, at least a portion of the stand 32 is made of magnetic or magnetizable material. If at least a portion of the positioning member 31 is made of magnetizable material, at least a portion of the stand 32 is made of magnetic material. Therefore, the positioning member 31 and the stand 32 are secured together by the attraction between the positioning member 31 and the stand 32, and the positioning member 31 can be rotated and held in a desired position to adjust orientation of the light-emitting device 100.

Figure 3:
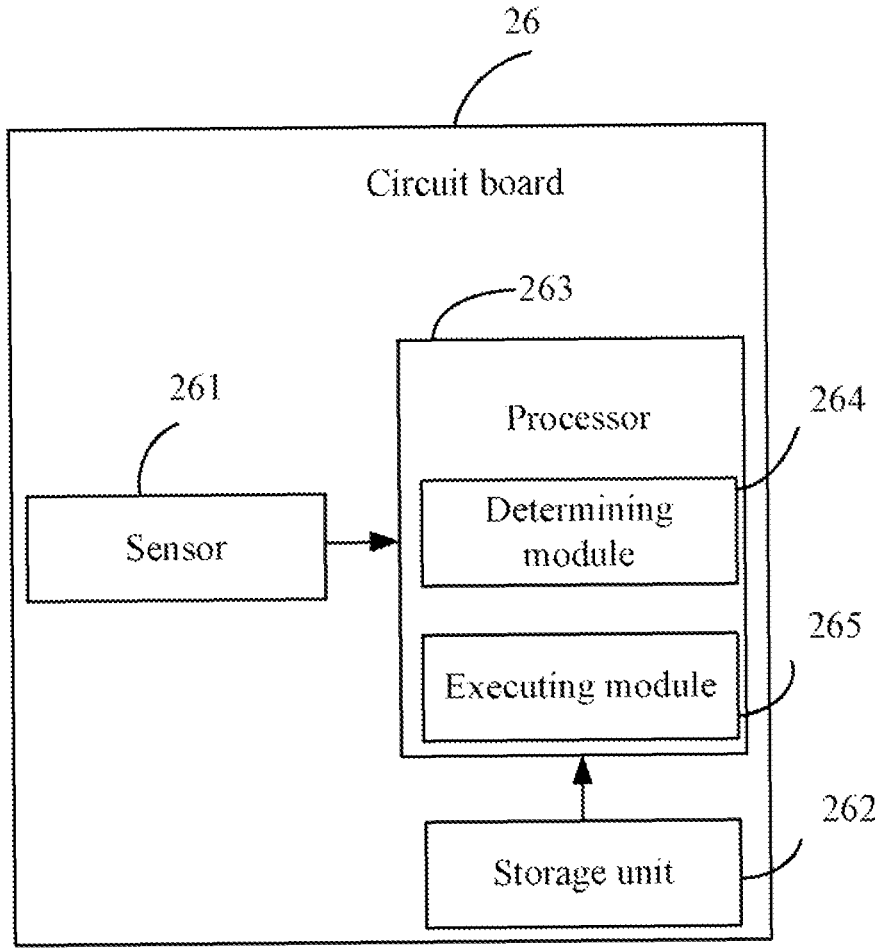
FIG. 3 is a block diagram of a circuit board of the light-emitting device of FIG. 1.

Referring to FIG. 3, a block diagram of the circuit board 26 is shown. The circuit board 26 includes a sensor 261, a storage unit 262, and a processor 263.

The sensor 261 detects the air pressure of the chamber 211. In one embodiment, the air pressure of the chamber 211 changes while the inflatable bag 23 is extruded.

The storage unit 262 stores a table recording relationship among different air pressure ranges, colors, and luminance values. As shown below, the table includes a first column recording different air pressure ranges, a second column recording different colors, and a third column recording different luminance values. Each air pressure range corresponds to one color and one luminance value. Each luminance value is a percentage of a greatest luminance of the light-emitting device 100.

TABLE

| Air pressure range | Color | Luminance |
|---|---|---|
| 100-110 KPa | Green | 30% |
| 111-120 KPa | Blue | 60% |
| 121-130 KPa | Yellow | 90% |
| 131-140 KPa | Red | 100% |
| ... | ... | ... |

The processor 263 includes a determining module 264 and an executing module 265.

In one embodiment, the determining module 264 is configured to determine whether the air pressure of the chamber 211 detected by the sensor 261, falls within one air pressure range recorded in the table, and determines the color and the luminance values corresponding to the detected air pressure range in the table if the detected air pressure falls within the air pressure range.

The executing module 265 is configured to control the emitting member 12 to emit light with the color and the luminance value determined by the determining module 264 if the detected air pressure falls within one air pressure range. Then it turns off the light emitting device 100 if the detected air pressure does not fall within any air pressure range.

In an alternative embodiment, the determining module 264 is configured to determine whether the air pressure of the chamber 211 is steady. The executing module 265 is configured to emit light with a single color and a fixed luminance value if the air pressure of the chamber 211 is steady, and is configured to emit light with various colors and luminance values alternatively if the air pressure of the chamber 211 changes.

It should be noted that in above embodiments, the executing module 265 is further configured to shut down the first valve 24 to prevent the air from going through when the air pressure of the chamber 211 reaches a predetermined value.

Figure 4:
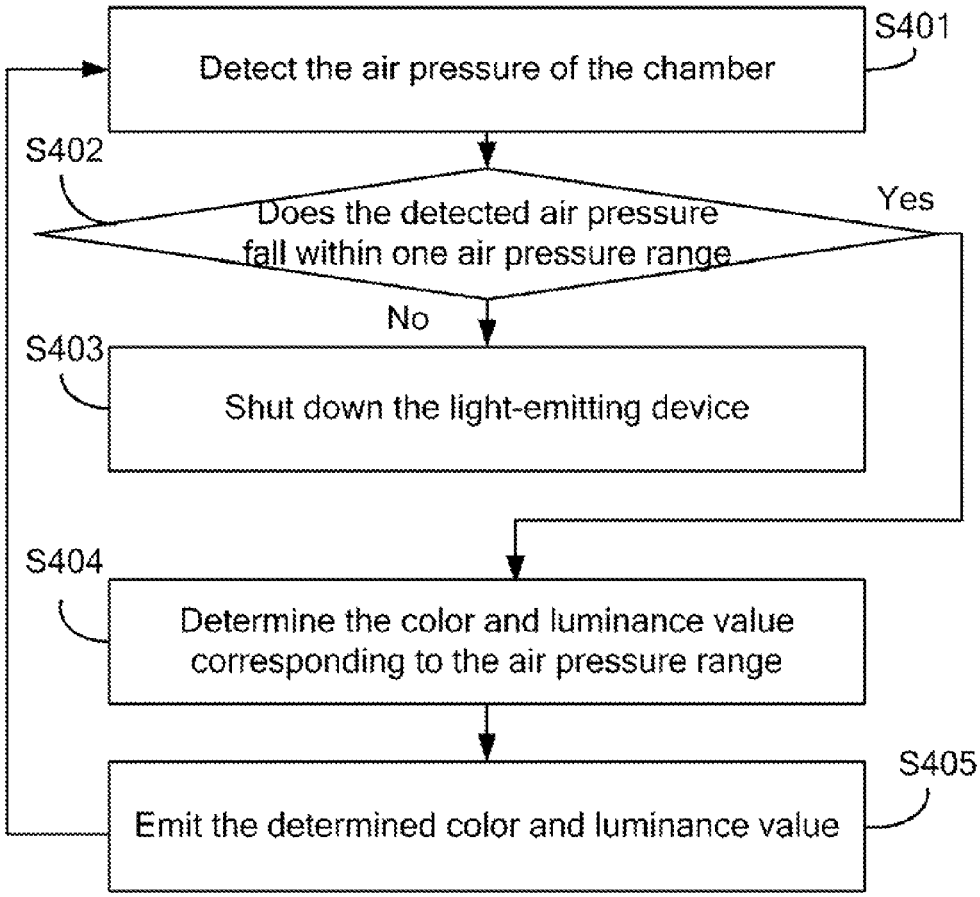
FIG. 4 is a flowchart of a light-emitting method in accordance with a first embodiment.

Referring to FIG. 4, a first embodiment of a method for controlling the light-emitting device 100 to emit light is shown.

In step S401, the sensor 261 detects the air pressure of the chamber 211.

In step S402, the determining module 264 determines whether the air pressure of the chamber 211 falls within one air pressure range in the table. If not, the procedure goes to step S403. If yes, the procedure goes to step S404.

In step S403, the executing module 265 shuts down the light-emitting device 100.

In step S404, the determining module 264 determines the color and luminance value corresponding to the air pressure range in the table.

In step S405, the executing module 265 controls the emitting member 12 to emit color and luminance value determined by the determining module 264, and the procedure goes to S401.

Figure 5:
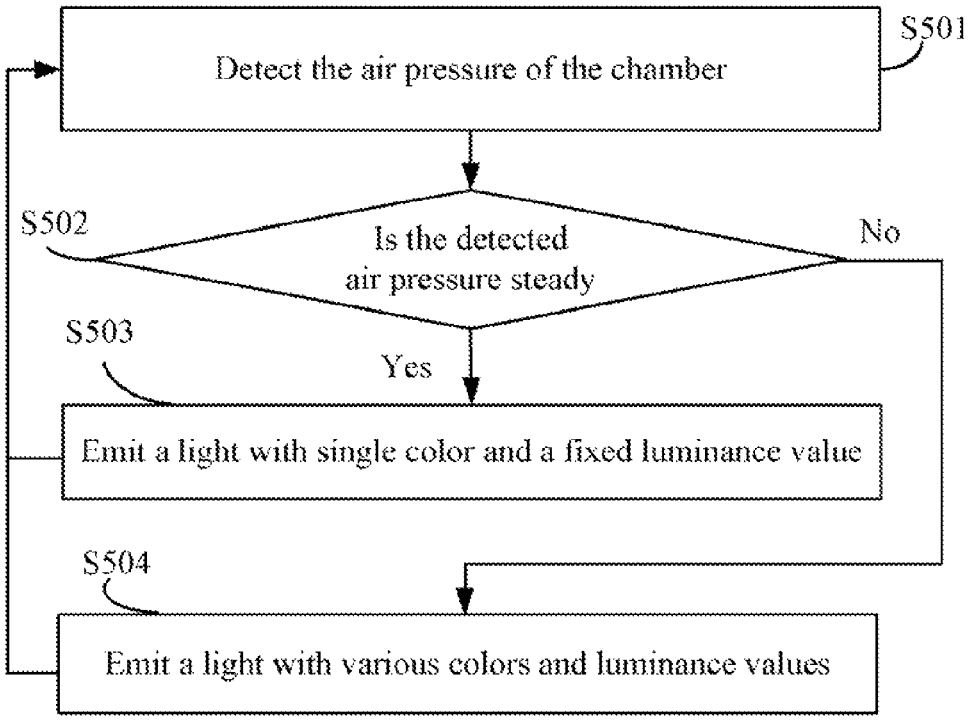
FIG. 5 is a flowchart of a light-emitting method in accordance with a second embodiment.

Referring to FIG. 5, a second embodiment of a method for controlling the light-emitting device 100 to emit light is shown.

In step S501, the sensor 261 detects the air pressure of the chamber 211.

In step S502, the determining module 264 determines whether the air pressure of the chamber 211 is steady. If yes, the procedure goes to step S503. If not, i.e., not kept within one air pressure, the procedure goes to step S504.

In step S503, the executing module 265 controls the emitting member 12 to emit a light with single color and a fixed luminance value, and the procedure goes to step S501.

In step S504, the executing module 265 controls the emitting member 12 to emit a light with various colors and luminance value alternatively, and the procedure goes to step S501.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A light-emitting device comprising:

a head comprising an emitting member configured to emit light; and a support secured to the head and comprising a circuit board, the circuit board comprising a sensor and a processor, the sensor to detect an air pressure of the light-emitting device, the processor being configured to control the emitting member to emit light with a color and a luminance value corresponding to the detected air pressure;

wherein the circuit board comprises a storage unit storing a table, the table comprises a first column recording different air pressure ranges, a second column recording different colors, and a third column recording different luminance values, each of the air pressure ranges corresponds to one of the colors and one of the luminance values, the processor comprises a determining module and an executing module, the determining module is configured to determine whether the detected air pressure falls within one of the air pressure ranges in the table, and determine the color and the luminance value corresponding to the detected air pressure range if the detected air pressure falls within the air pressure range, the executing module is configured to control the emitting member to emit light with the color and the luminance value determined by the determining module.

2. The light-emitting device as described in claim 1, wherein the executing module is configured to shut down the light-emitting device if the determining module determines that the detected air pressure does not fall within one of the air pressure ranges.

3. The light-emitting device as described in claim 1, wherein the processor comprises a determining module and an executing module, the determining module is configured to determine whether the detected air pressure is steady, the executing module is configured to control the emitting member to emit a light with a single color and a fixed luminance value if the detected air pressure is steady, and further configured to control the emitting member to emit light with various colors and luminance values if the detected air pressure changes.

4. The light-emitting device as described in claim 1, wherein the head comprises a lampshade defining a receiving space, the support comprises a first rod and a second rod, the emitting member is arranged on a top end of the first rod, the first rod defines a first through hole, the receiving space and the first through hole cooperatively define a chamber, the sensor is configured to detect the air pressure of the chamber.

5. The light-emitting device as described in claim 4, wherein the size of the lampshade changes when the air pressure of the chamber changes.

6. The light-emitting device as described in claim 4, wherein the second rod defines a second through hole, the support comprises an inflatable bag defining a third through hole, opposite ends of the inflatable bag are attached to the first rod and the second rod, the inflatable bag inflates the chamber through the second through hole and the third through hole when the inflatable bag is extruded.

7. The light-emitting device as described in claim 6, wherein the support comprises a first valve and a second valve, the first valve is arranged in the first through hole of the first rod, the second valve is arranged in the second through hole of the second rod, the first valve and the second valve allow gas to flow through them along a direction towards the lampshade.

8. The light-emitting device as described in claim 1, further comprising a base connected to the support, wherein the base comprises a positioning member and a stand, the stand defines a recessed portion to receive the positioning member.

9. The light-emitting device as described in claim 8, wherein at least a portion of the positioning member is made of magnetic material, and at least a portion of the stand is made of magnetic or magnetizable material.

10. The light-emitting device as described in claim 8, wherein at least a portion of the positioning member is made of magnetizable material, and at least a portion of the stand is made of magnetic material.

11. The light-emitting device as described in claim 8, wherein the positioning member defines a plurality of holes, the gas is inflated into the positioning member through the holes.

12. The light-emitting device as described in claim 11, wherein when the positioning member is received in the recessed portion, the holes are exterior to the recessed portion.

13. A light-emitting method applied in a light-emitting device, the light-emitting device comprising an emitting member to emit light, the method comprising:

detecting an air pressure of the light-emitting device; and controlling the emitting member to emit light with a color and a luminance value according to the detected air pressure;

wherein the light-emitting device comprises a storage unit storing a table, the table comprises a first column recording different air pressure ranges, a second column recording different colors, and a third column recording different luminance values, each of the air pressure ranges corresponds to one of the colors and luminance values, the step of "controlling the emitting member to emit light with a color and a luminance value according to the detected air pressure" comprises:

determining whether the detected air pressure falls within the air pressure range;

determining the color and luminance value corresponding to the air pressure range and controlling the emitting member to emit determined color and luminance if the detected air pressure falls within one of the air pressure range; and shutting down the emitting member if the detected air pressure does not fall within one of the air pressure ranges.

14. The method as described in claim 13, wherein the step "controlling the emitting member to emit light with a color and a luminance according to the detected air pressure" comprises:

determining whether the detected air pressure is steady;

controlling the emitting member to emit light with a signal color and a fixed luminance value if the determined air pressure is steady; and controlling the emitting member to emit light with various colors and luminance values if the detected air pressure changes.

15. A light-emitting device comprising:

a head comprising an emitting member and a lampshade, the emitting member being configured to emit light, the lampshade defining a first receiving space, the emitting member being received in the first receiving space;

a support connected to the lampshade, comprising a first rod, a second rod, a first valve, a second valve, an inflatable bag, and a circuit board, the first rod and the second rod respectively defining a first through hole and a second through hole, the first receiving space and the first through hole cooperatively defining a chamber, the first valve and the second valve being respectively received in the first through hole and the second through hole, the inflatable bag defining a third through hole, opposite ends of the inflatable bag being attached to the first rod and the second rod, the inflatable bag inflating the chamber through the third through hole when the inflatable bag is extruded, the circuit board comprising a sensor and a processor, the sensor being configured to detect an air pressure of the chamber, the processor being configured to control the emitting member to emit light with a color and a luminance value according to the detected air pressure of the chamber; and a base connected to the second rod, the base defining a second receiving space and a plurality of holes, the second receiving space communicating with the second through hole, the gas going into the base through the holes when inflating and flowing towards the chamber through the second receiving space.

16. The light-emitting device as described in claim 15, wherein the light-emitting device comprises a storage unit storing a table, the table comprises a first column recording different air pressure ranges, a second column recording different colors, and a third column recording different luminance values, each of the air pressure ranges corresponds to one of the colors and one of the luminance values, the processor comprises a determining module and an executing module, the determining module is configured to determine whether the air pressure of the light-emitting device falls within one air pressure range of the table, the determining module determines the color and luminance corresponding to the air pressure range of the table and the executing module controls the emitting member to emit light with a color and a luminance value if the detected air pressure falls within one air pressure range of the table.

17. The light-emitting device as described in claim 15, wherein the processor comprises a determining module and an executing module, the determining module is configured to determine whether the air pressure is steady, the executing module controls the emitting member to emit light with a signal color and a fixed luminance value if the detected air pressure is steady; the executing module controls the emitting member to emit a light with various colors and luminance values if the detected air pressure changes.

18. The light-emitting device as described in claim 15, wherein the size of the lampshade changes when the air pressure of the chamber changes.

* * * * *